US007972168B2

(12) United States Patent
Su et al.

(10) Patent No.: US 7,972,168 B2
(45) Date of Patent: Jul. 5, 2011

(54) CABLE CONNECTOR ASSEMBLY WITH AN IMPROVED APPARENT MEMBER

(75) Inventors: Ping-Sheng Su, Tu-Cheng (TW); Dou-Feng Wu, Kunshan (CN); Wei Zhang, Kunshan (CN)

(73) Assignee: Hon Hai Precision Ind. Co., Ltd., Taipei (TW)

( * ) Notice: Subject to any disclaimer, the term of this patent is extended or adjusted under 35 U.S.C. 154(b) by 0 days.

(21) Appl. No.: 12/878,203

(22) Filed: Sep. 9, 2010

(65) Prior Publication Data

US 2011/0059640 A1 Mar. 10, 2011

(30) Foreign Application Priority Data

Sep. 9, 2009 (CN) ..... 2009 20 309968

(51) Int. Cl.
*H01R 13/622* (2006.01)

(52) U.S. Cl. ..... 439/491

(58) Field of Classification Search ..... 439/491, 439/488
See application file for complete search history.

(56) References Cited

U.S. PATENT DOCUMENTS

| | | | | |
|---|---|---|---|---|
| 4,202,351 | A * | 5/1980 | Biche | 600/508 |
| 4,674,820 | A * | 6/1987 | Foster et al. | 439/522 |
| 6,443,759 | B1 * | 9/2002 | Matsuda et al. | 439/488 |
| 6,752,650 | B1 * | 6/2004 | Lin | 439/491 |
| 7,575,465 | B2 * | 8/2009 | Hanks | 439/427 |

* cited by examiner

*Primary Examiner* — Gary F. Paumen
(74) *Attorney, Agent, or Firm* — Wei Te Chung; Andew C. Cheng; Ming Chieh Chang

(57) ABSTRACT

A cable connector assembly (100) comprises an insulative housing (1), a contact group (2, 3) assembled with the insulative housing, an insulated cover (5), a cable (4) connected with the contact group, and an apparent member (6) with a columnar shape having a right-hand thread (61) on one end of an inner wall thereof and a left-hand thread (62) on the opposite end, and the inner wall of the apparent member is matched with the insulated cover via the threads in different directions.

15 Claims, 4 Drawing Sheets

CABLE CONNECTOR ASSEMBLY WITH AN IMPROVED APPARENT MEMBER

BACKGROUND OF THE INVENTION

1. Field of the Invention

The present invention generally relates to a cable connector assembly, and more particularly to a cable connector assembly transmitting power signal.

2. Description of Related Art

As development of electronic technology, electronic equipments are designed smaller and having more function. Nowadays, cable connector assemblies are widely used in an electronic equipment, especially for transmitting power, and the performance of the cable connector assembly directly impacts on the entire electronic equipment whether can normally run. A conventional cable connector assembly comprises an inner contact as a positive contact and an outer contact as a negative contact, and the cable connector assembly transmits power with the positive contact and the negative contact. And the cable connector assembly also has an insulative housing spaced the positive contact apart from the negative contact, and a cable with a plurality of conductive wires connected with corresponding contact.

Additionally, the appearance and quality of electronic equipment are required strongly by consumers, and a cable connector assembly with small profile usually has an ornamental member to meet pleasure of user. The ornamental member is conventionally smaller in size with high cost, and attached on an electrical connector via glue to form the cable connector assembly. However, the electrical connector becomes hot when run in electrical connection, then the glue will be intenerated, and the ornamental member maybe separate from the electrical connector.

Hence, it is desirable to have an improved structure to overcome the above-mentioned disadvantages of the prior art.

BRIEF SUMMARY OF THE INVENTION

Accordingly, the object of the present invention is to provide a cable connector assembly with an apparent member prevent separate thereof from the cable connector assembly.

In order to achieve the above-mentioned object, a cable connector assembly in accordance with the present invention comprises an insulative housing, a contact group assembled with the insulative housing, an insulated cover, a cable connected with the contact group, and an apparent member with a columnar shape having a right-hand thread on one end of an inner wall thereof and a left-hand thread on the opposite end, and the inner wall of the apparent member is matched with the insulated cover via the threads in different directions.

Other objects, advantages and novel features of the invention will become more apparent from the following detailed description of the present embodiment when taken in conjunction with the accompanying drawings.

DETAILED DESCRIPTION OF THE INVENTION

Figure 1:
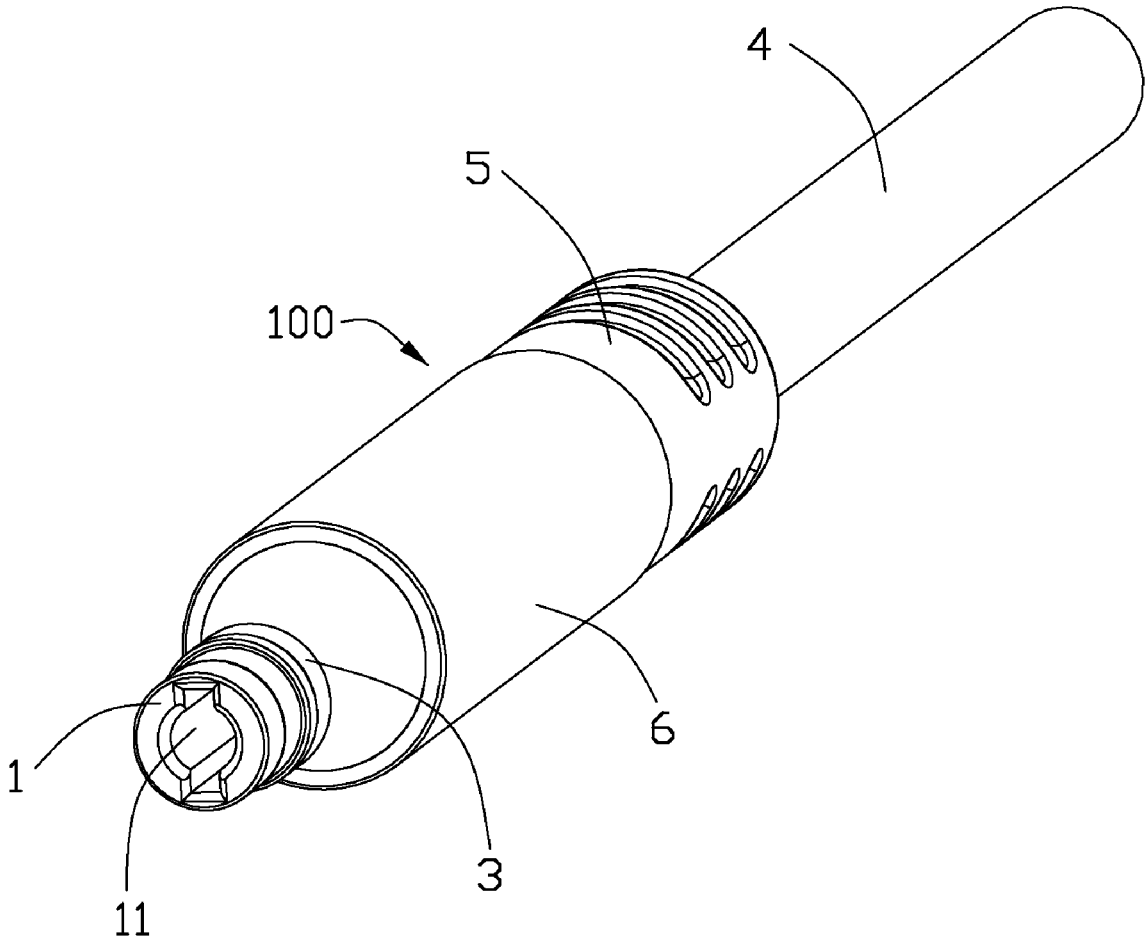
FIG. 1 is an assembled view of a cable connector assembly in accordance with the present invention.

Reference will now be made to the drawing figures to describe the present invention in detail.

Figure 2:
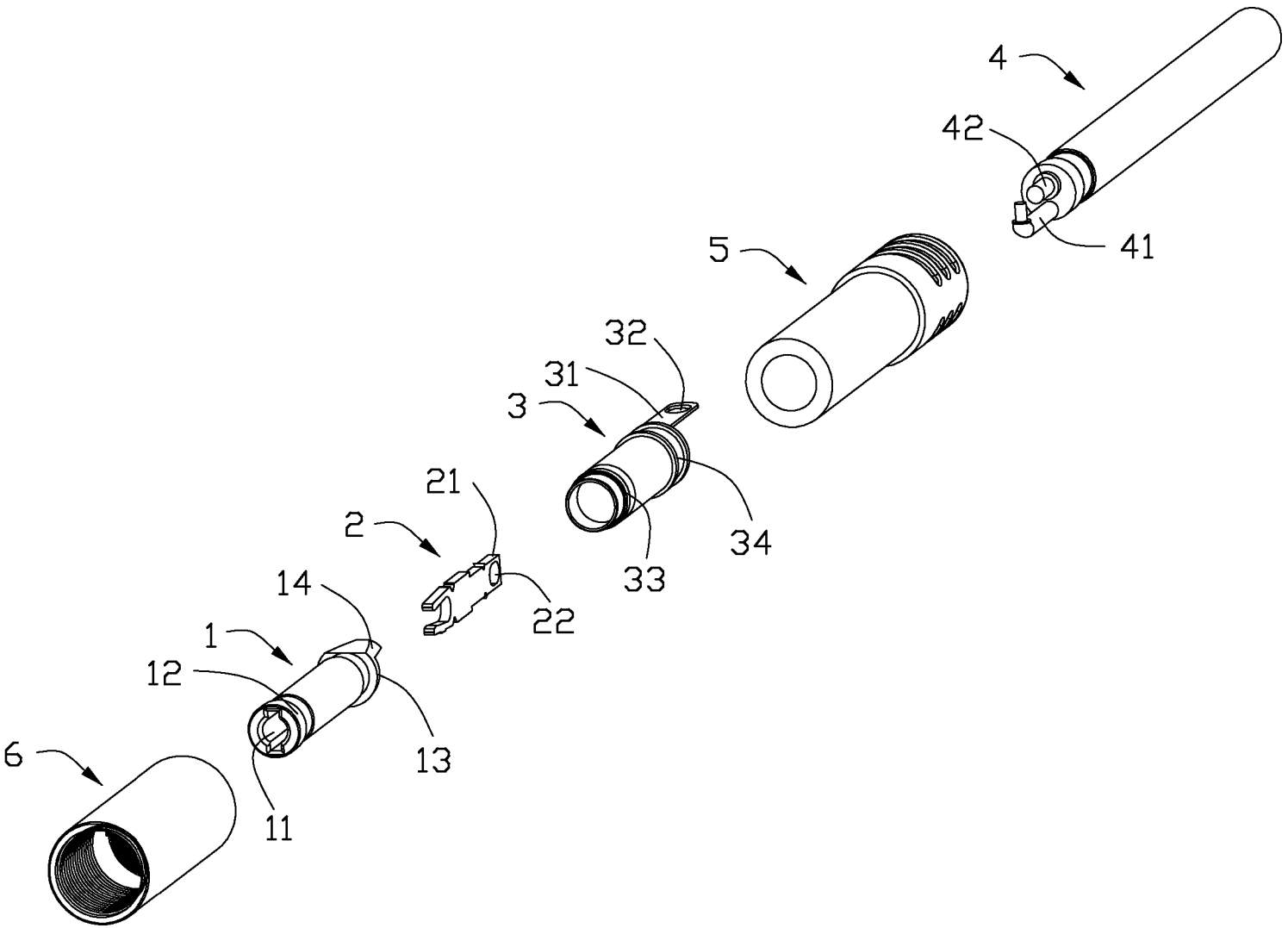
FIG. 2 is an exploded, perspective view of the cable connector assembly shown in FIG. 1.
Figure 3:
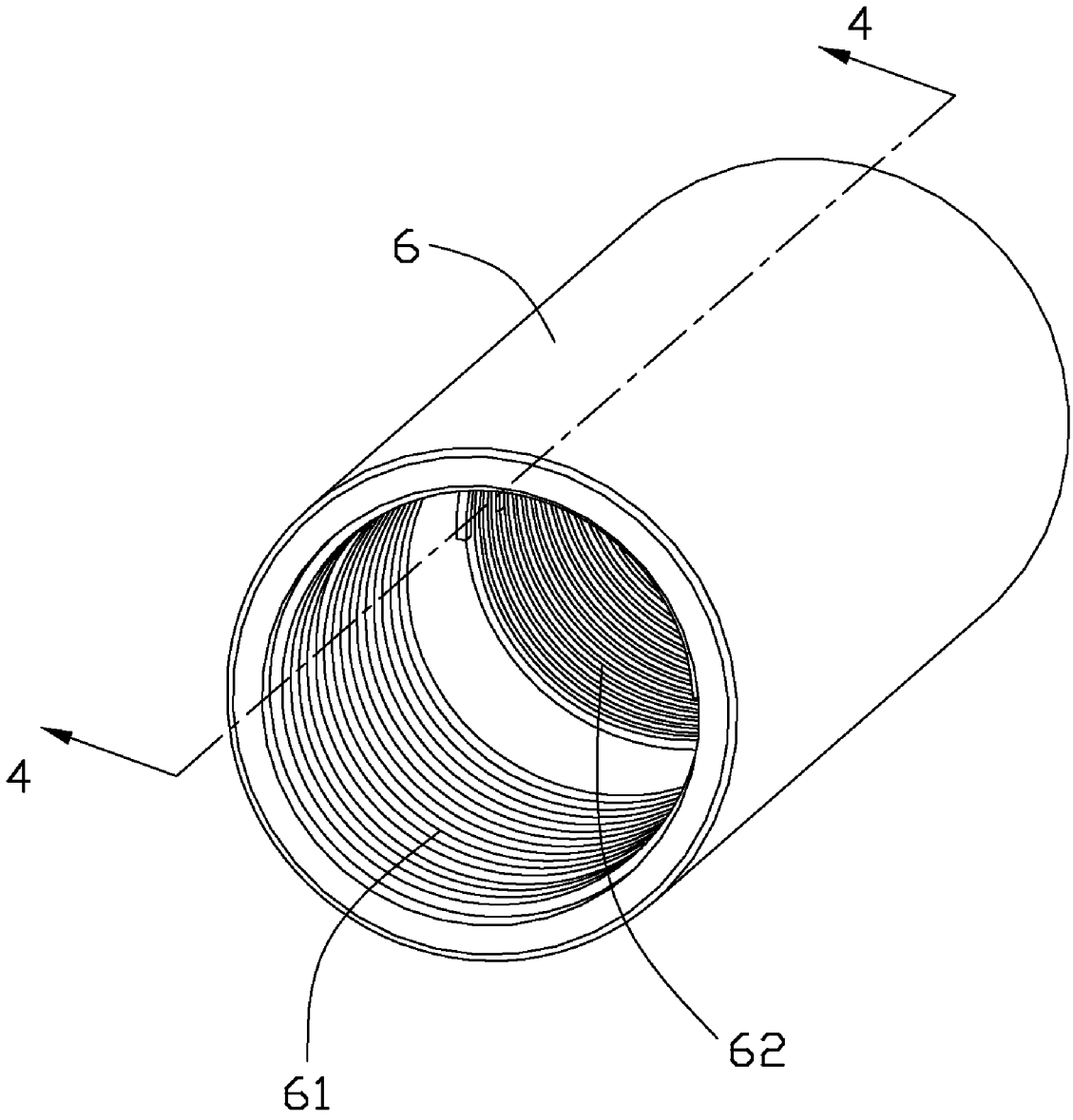
FIG. 3 is a perspective view of the apparent member shown in FIG. 2.
Figure 4:
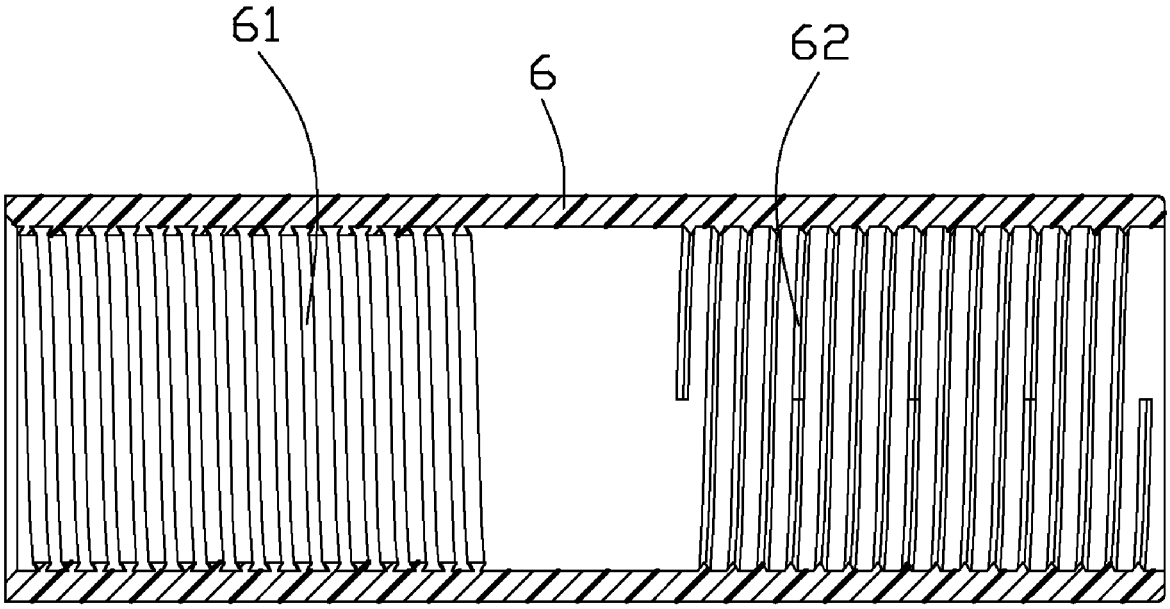
FIG. 4 is a cross-section view of the apparent member take along line 4-4 of FIG. 3.

Referring to FIGS. 1-4, a cable connector assembly 100 made in accordance with the present invention is a power plug, and comprises an insulative housing 1, a positive contact 2, a negative contact 3, a cable 4, an insulated cover 5 and an apparent member 6. The cable 4 comprises a positive wire 41 and a negative wire 42 connected with corresponding contacts.

The insulative housing 1 has a hollow configuration with a cylindrical shape, and is configured with a cavity 11, a first protruding portion 12 on a front end thereof, a second protruding portion 13 on a rear end thereof and a tuber 14 extending rearwards from the second protruding portion 13.

The positive contact 2 is arranged in the cavity of the insulative housing 1, and includes a soldering portion 21 exposed out of the insulative housing 1, and a through hole 22 located in the soldering portion 21 for the positive wire 41 being inserted into.

The negative contact 3 is of columnar shape, and has a connecting portion 31 extending backwards and an aperture 32 in the connecting portion 31 for the negative wire 42 being inserted into. The insulative housing 1 is received in the negative contact 3, the first protruding portion 12 of the insulative housing 1 is adjacent to a front end of the negative contact 3 and the second protruding portion 13 is adjacent to a rear end of the negative contact 3, to prevent the negative contact 3 separating from the insulative housing 1. The soldering portion 21 is soldered and connected with the positive wire 41 and the connecting portion 31 is soldered and connected with the negative wire 42, and the soldering portion 21 is spaced apart from the connecting portion 31 via the tuber 14. The negative contact 3 defines an annular rib 33 on a front end of an outer surface thereof for latching with a complementary connector (not shown), and a retaining portion 34 is arranged on the opposite end of the negative contact 3 to cooperate with the insulated cover 5 interferentially.

The apparent member 6 is made of metallic material and configured with a columnar shape, and defines a right-hand thread on an inner wall thereof and a left-hand thread opposite to the right-hand thread on the inner wall, the right-hand thread is arranged on a front segment of the inner wall and the left-hand thread is arranged on a rear segment of the inner wall. Additionally, the apparent member 6 could be defined with an ingenious design or mark selectively. The insulated cover 5 is injection molded in the apparent member 6, and encloses the negative contact 3 with the positive contact 2 and the insulative housing 1 received in, and the insulated cover 5 is enclosing a front part of the cable 4.

The apparent member 6 has two threads in opposite directions on the inner wall, so the apparent member 6 is combined with the insulated cover 5 tightly without separation due to no rotation therebetween can be obtained. In addition, the apparent member 6 can be made of plastic material in other embodiment in accordance with the present invention. Alternately, arrangement of the different pitches of the two threads to replace the opposite rotation directions of the threads, can also prevent relative rotation between the apparent member 6 and the insulated cover 5. On the other hand, the different cross-sectional configurations of the thread structures of the two threads may achieve the similar anti-rotation function.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an insulative housing;

a contact group assembled with the insulative housing;

an insulated cover;

a cable connected with the contact group; and an apparent member with a columnar shape having a right-hand thread on one end of an inner wall thereof and a left-hand thread on the opposite end, and the inner wall matched with the insulated cover via the threads in different directions.

2. The cable connector assembly as claimed in claim 1, wherein the insulative housing is of cylindrical shape, and comprises a cavity, a first protruding portion on a front end thereof, a second protruding portion on a rear end thereof and a tuber extending rearwards from the second protruding portion.

3. The cable connector assembly as claimed in claim 2, wherein the contact group is used for transmitting power and comprises a positive contact and a negative contact.

4. The cable connector assembly as claimed in claim 3, wherein the cable has a positive wire and a negative wire soldered with the positive contact and the negative contact correspondingly.

5. The cable connector assembly as claimed in claim 4, wherein the positive contact is received in the cavity of the insulative housing, and comprises a soldering portion exposed out of the insulative housing and a through hole located in the soldering portion for the positive wire being inserted into.

6. The cable connector assembly as claimed in claim 5, wherein the insulative housing is received in the negative contact, the first protruding portion of the insulative housing is adjacent to a front end of the negative contact and the second protruding portion is adjacent to a rear end of the negative contact, to prevent the negative contact separating from the insulative housing.

7. The cable connector assembly as claimed in claim 5, wherein the negative contact is of columnar shape, and has a connecting portion extending backwards and an aperture in the connecting portion for the negative wire being inserted into.

8. The cable connector assembly as claimed in claim 7, wherein the soldering portion is spaced apart from the connecting portion via the tuber.

9. The cable connector assembly as claimed in claim 8, wherein the negative contact defines an annular rib on a front end of an outer surface thereof for latching with a complementary connector, and a retaining portion is arranged on the opposite end of the negative contact to cooperate with the insulated cover interferentially.

10. The cable connector assembly as claimed in claim 1, wherein the apparent member is made of metallic material and defines with an design or mark selectively.

11. An electrical connector comprising:

an inner insulative housing;

an inner contact disposed in the housing;

an outer contact intimately surrounding the housing;

an outer insulator intimately surrounding the outer contact;

a metallic apparent member intimately surrounding the outer insulator with inner thread structure with opposite first and second axial sections extending in opposite rotation directions with each other; wherein an exterior surface of said outer insulator compliantly and intimately contacts said inner thread structure via an insert molding procedure.

12. The electrical connector as claimed in claim 11, wherein said first and second axial sections are respectively located at opposite first and second ends of the apparent member.

13. The electrical connector as claimed in claim 11, wherein a pitch of the first axial section is essentially same with that of the second axial section.

14. The electrical connector as claimed in claim 11, wherein a cross-section configuration of each thread of the first axial section is different from that of the second axial section.

15. An electrical connector comprising:

an inner insulative housing;

an inner contact disposed in the housing;

an outer contact intimately surrounding the housing;

an outer insulator intimately surrounding the outer contact;

a metallic apparent member intimately surrounding the outer insulator with inner thread structure with opposite first and second axial sections having different pitches or cross-sectional configurations on each thread from each other; wherein an exterior surface of said outer insulator compliantly and intimately contacts said inner thread structure via an insert molding procedure.

* * * * *